United States Patent [19]

Mikata et al.

[11] Patent Number: 4,813,205

[45] Date of Patent: Mar. 21, 1989

[54] WEIGHING AND PACKING DEVICE HAVING METAL DETECTOR

[75] Inventors: Yoshitaka Mikata, Himeji; Tadashi Higuchi, Akashi; Isao Miyamoto, Himeji, all of Japan

[73] Assignee: Yamato Scale Company Limited, Japan

[21] Appl. No.: 130,745

[22] Filed: Dec. 9, 1987

[30] Foreign Application Priority Data

Dec. 10, 1986 [JP] Japan ..... 61-294358

[51] Int. Cl.[4] ..... B65B 57/00; B65B 1/32

[52] U.S. Cl. ..... 53/53; 53/167; 53/502; 53/551; 53/52; 209/657

[58] Field of Search ..... 53/53, 52, 502, 167, 53/551, 552; 73/52, 169, 865.8; 209/657, 215; 177/50; 493/16, 37

[56] References Cited

U.S. PATENT DOCUMENTS

| | | | |
|---|---|---|---|
| 3,477,197 | 11/1969 | Budz | 53/53 |
| 4,288,965 | 9/1981 | James | 53/64 |
| 4,548,286 | 10/1985 | Sashiki et al. | 53/502 X |
| 4,643,027 | 2/1987 | Deutsch et al. | 53/53 X |
| 4,662,154 | 5/1987 | Hayward | 53/53 X |
| 4,691,496 | 9/1987 | Anderson et al. | 53/53 |

*Primary Examiner*—James F. Coan

*Attorney, Agent, or Firm*—Senniger, Powers, Leavitt and Roedel

[57] ABSTRACT

A weighing and packing device including a weighing section for successively weighing out quantities of product each having a predetermined weight and a packing section for successively packing the quantities of product delivered from the weighing section. The device further includes a metal detector for detecting a metallic substance included in each quantity of product and means for enabling removal of defective packages containing metallic substances from the normal conveying line.

8 Claims, 5 Drawing Sheets

WEIGHING AND PACKING DEVICE HAVING METAL DETECTOR

BACKGROUND OF INVENTION

This invention relates to a weighing and packing device for making packages of product each containing a quantity of product having a weight equal or close to a predetermined value and, especially, to such device including a metal detector.

In a combination weighing machine as disclosed for example in U.S. Pat. No. 4,560,015, product is distributively fed to a plurality of weighers and the resultant weight values are combined in various fashion for selecting from the resultant combinations a combination having a total weight equal or close to a predetermined weight and discharging a batch of product forming the selected combination from the corresponding weighers at the same time. This operation is repeated for successively delivering batches of product of desired weight.

On the other hand, U.S. Pat. No, 4,288,965 discloses a form-fill-seal packing machine in which a web of flexible packing material is pulled from a supply roll and fed over a device for forming it into tubing, product to be packed is fed into the tubing and the tubing is sealed to form packages. When such a packing machine is coupled vertically with the above-mentioned combination weighing machine, a weighing and packing device is formed.

In a combination weighing and packing device, metal pieces might become mixed in with the product before it is fed to the weighers. For example, when the product is worked, broken pieces of a cutting tool may mix in or when the product is contained in a large bag before it is fed to the weighers, staples used for closing the bag may mix in with the product when the product is unloaded from of the bag. In the past, such product including any metallic substances has passed into the combination weighing machine and has been fed to the packing device and packed. This has created a problem in that the metallic substance may be swallowed by a consumer of this package.

SUMMARY OF INVENTION

Therefore, an object of this invention is to provide an improved weighing and packing device having means for detecting any metallic substance mixed in with the product and making it possible to distinguish a package containing the detected substance from other packages.

This object can be attained in accordance with this invention by the provision of a weighing and packing device comprising a combination weighing machine for combining weights of product contained in a plurality of containers in various fashion to select from the resultant combinations a combination having a total weight satisfying a predetermined condition and discharging the product forming the selected combination from the corresponding containers, and a packing machine for packing the discharged product in a package. The device further comprises a metal detector disposed along a product path between the weighing machine and the packing machine for producing a metal detection signal when a metallic substance passes this path with the product, and means for distinguishing a package containing the detected metallic substance from other packages not containing a metallic substance.

In an embodiment of this invention, the distinguishing means is a deflecting device disposed after the packing machine for deflecting the package containing the metallic substance from the normal conveying path. In another embodiment, the distinguishing means is a control device for controlling the packing machine to change the shape or size of the package containing the metallic substance from the shape or size of normal package.

These and other objects and features of this invention will be described in more detail below with reference to the accompanying drawings.

BRIEF DESCRIPTION OF THE DRAWINGS

In the drawings

Throughout the drawings, the same reference numerals are given to corresponding components.

DESCRIPTION OF THE PREFERRED EMBODIMENTS

Figure 1:
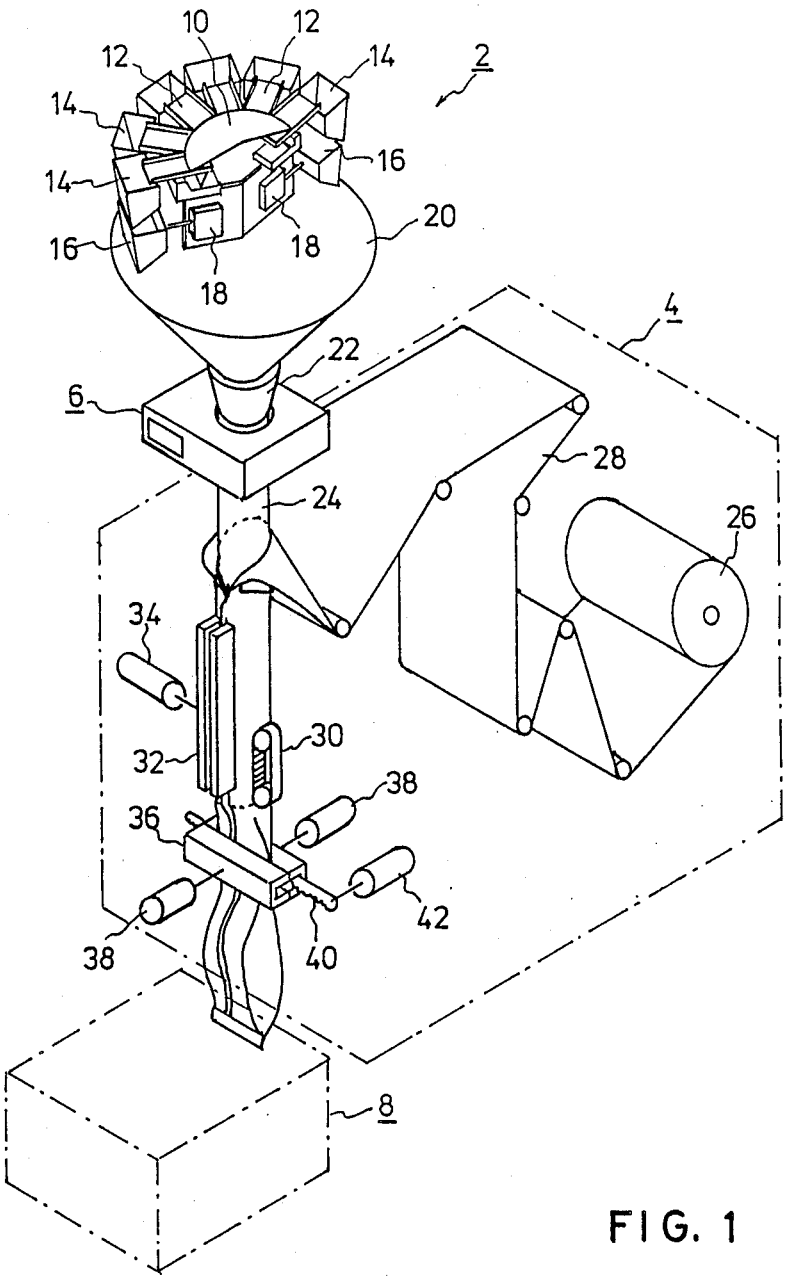
FIG. 1 is a perspective view representing a schematic configuration of a first embodiment of the weighing and packing device having a metal detector according to this invention.
Figure 2:
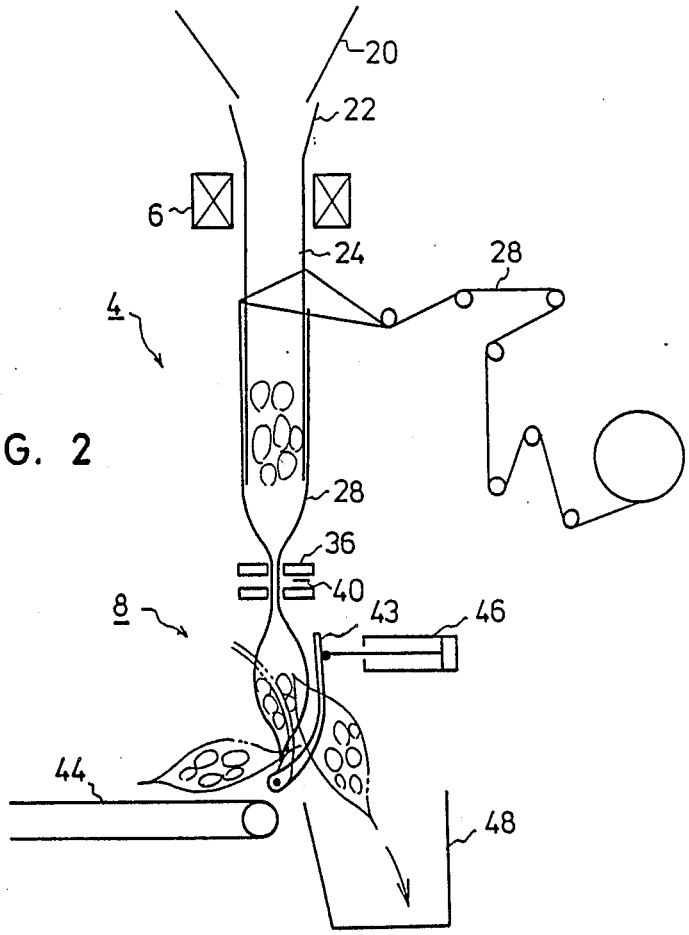
FIG. 2 is a schematic side view of the first embodiment illustrating a packing device and a deflecting device.

Referring to FIGS. 1 and 2, there is shown an embodiment of this invention including a combination weighing device 2, a packing device 4, a metal detector 6 and a deflector 8 serving as distinguishing means. The combination weighing device 2 includes a conical dispersion feeder 10, a plurality of radial feeding troughs 12 surrounding the dispersion feeder 10 and a plurality of feed hoppers 14 disposed at the outer ends of the feeding troughs 12. Weigh hoppers 16 are disposed under the feed hoppers 14 and are provided with load detectors 18 such as load cells. A collection chute 20 is disposed under the weigh hoppers 16 for collecting product discharged from the weigh hoppers 16.

The combination weighing device detects the weights of product by the respective weight detectors 18, combines these weights in various fashion, selects from the resultant combinations a combination having a total weight equal or nearest to a predetermined weight, and discharges the product forming the selected combination from the corresponding weigh hoppers 16 into the collection chute 20. The emptied weigh hoppers 16 are then refilled with new product from the overlying feed hoppers 14 and the same weighing and combination selecting operation is repeated. More detailed description of the combination weighing device will be omitted since this is not the subject of this invention.

The packing device 4 for packing the batch of product discharged from the combination weighing device 2 includes a chute 22 connected at its upper end to the collection chute 20. The chute 22 is made of non-metallic material such as synthetic resin. The chute 22 is connected at its lower end to a forming tube 24 and directs product into the latter. A synthetic resin film 28 such as polyethylene film wound on a drum 26 is wrapped around the forming tube 24 and one side edge margin of the film 28 is lapped on the other side edge margin to form a longitudinal seam of a cylinder which is hereafter referred to as "primary semiproduced bag". A pair of endless belts 30 are disposed on opposite sides of the forming tube 24 in contact with the film 28 for feeding downwards the primary semiproduced bag and drawing new film 28 onto the forming tube 24.

A pair of heated longitudinal sealing bars 32 disposed vertically along the seam of the primary semiproduced bag are actuated by an air-cylinder 34 to pinch the seam and thermally weld it. A pair of heated lateral sealing bars 36 are disposed horizontally at the front and rear sides of the semiproduced bag and driven by a pair of air-cylinders 38 to thermally seal the bottom of the primary semiproduced bag to form a "secondary semiproduced bag". (In normal continuous operation, as shown in FIG. 1, the top of the preceding secondary semiproduced bag is also sealed at the same time by the lateral sealing bars 36.) Then, product is discharged from the combination weighing device 2 and falls into the forming tube 24. Thereafter, the lateral sealing bars 36 are opened and the secondary semiproduced bag is fed downwards by the endless belt 30 a predetermined normal length of the completed bag, thereby causing the product in the forming tube 24 to fall into the bag. The lateral sealing bars 36 are provided with a cutter mechanism including a knife 40 actuated by an air-cylinder 42. The knife 40 is moved by the cylinder 42 to sever the sealed top of the completed bag at the same time as it is sealed by the lateral sealing bars.

As shown in FIGS. 1 and 2, a metal detector 6 is disposed around the chute 22 for forming a magnetic field in this region of the chute 22. The detector 6 detects an electromotive force generated by a metallic substance passing through this region to produce a metal detection signal.

Referring to FIG. 2, the deflector unit 8 includes a deflector plate 43 having its lower edge pivoted under the lateral sealing bars 36 and, in the normal state, it is in the position as shown to deflect the completed bags to a belt conveyer 44 for delivery. However, when a metallic substance is detected by the metal detector 6, an air-cylinder 46 is actuated by the metal detection signal to move the deflector plate 43 to the position shown in phantom, thereby deflecting the defective bag into a container 48.

Figure 3:
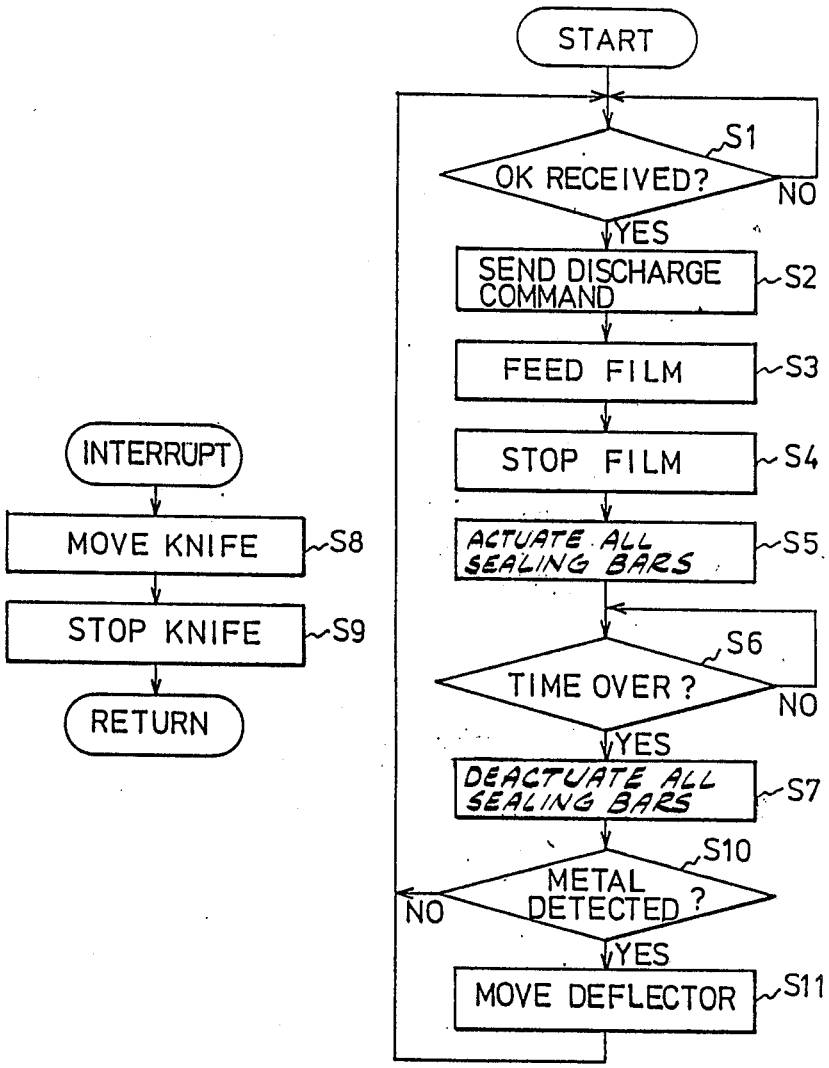
FIG. 3 is a flow chart of the first embodiment.

Though not shown in the drawings, the packing device 4 and the deflector unit 8 are controlled by a control unit the operation of which will be described with reference to the flow chart of FIG. 3. In the first step S1, it is inquired whether an OK signal is received or not. The signal is a combination acceptance signal indicative of the completion of a combination selection which is provided by the control unit (not shown) of the combination weighing device. When the OK signal is received, the control unit provides a discharge command signal to the control unit of the combination weighing device. Thus, the combination weighing machine discharges the product of the selected combination through collection chute 20 and chute 22 into the forming tube 24.

During the fall of this product into the forming tube 24, the endless belts 30 start to feed the film 28 downwards in step S3 and, after the feed of one bag length, stop the feed in step S4. During steps S3 and S4, the secondary semiproduced bag on the forming tube 24 is extruded downwards and a new primary semiproduced bag begins to be produced.

In the next step S5, the longitudinal sealing bars 32 are actuated to seal the seam of the primary semi-produced bag and, at the same time, the lateral sealing bars 36 are actuated to seal the top of the secondary semiproduced bag and the bottom of the primary semiproduced bag. It is inquired in step S6 whether a predetermined sealing time is over or not and, if YES, the sealing bars 32 and 36 are deactivated and opened to release the semiproduced bags. A predetermined time after the beginning of step S7, an interrupt routine is executed to drive the knife 40 in step S8 and to stop it in step S9, thereby cutting off the completed package from the secondary semiproduced bag.

Next, in step S10, it is required whether any metal has been detected in the product contained in the package produced now. As afore-mentioned, a metal detection signal is produced when the product in question passes the metal detector 6 if it includes any metallic substance. The answer to the inquiry of step S10 is made relying upon presence or absence of this signal. If no metal has been detected, the program returns to the start point and the produced package is normally conveyed by the belt conveyer 44. If any metal has been detected, the deflector plate 43 is driven by the air-cylinder 46 in step S11 to the position shown in phantom (FIG. 2) and the package is deflected into the container 48 as afore-mentioned.

Figure 4:
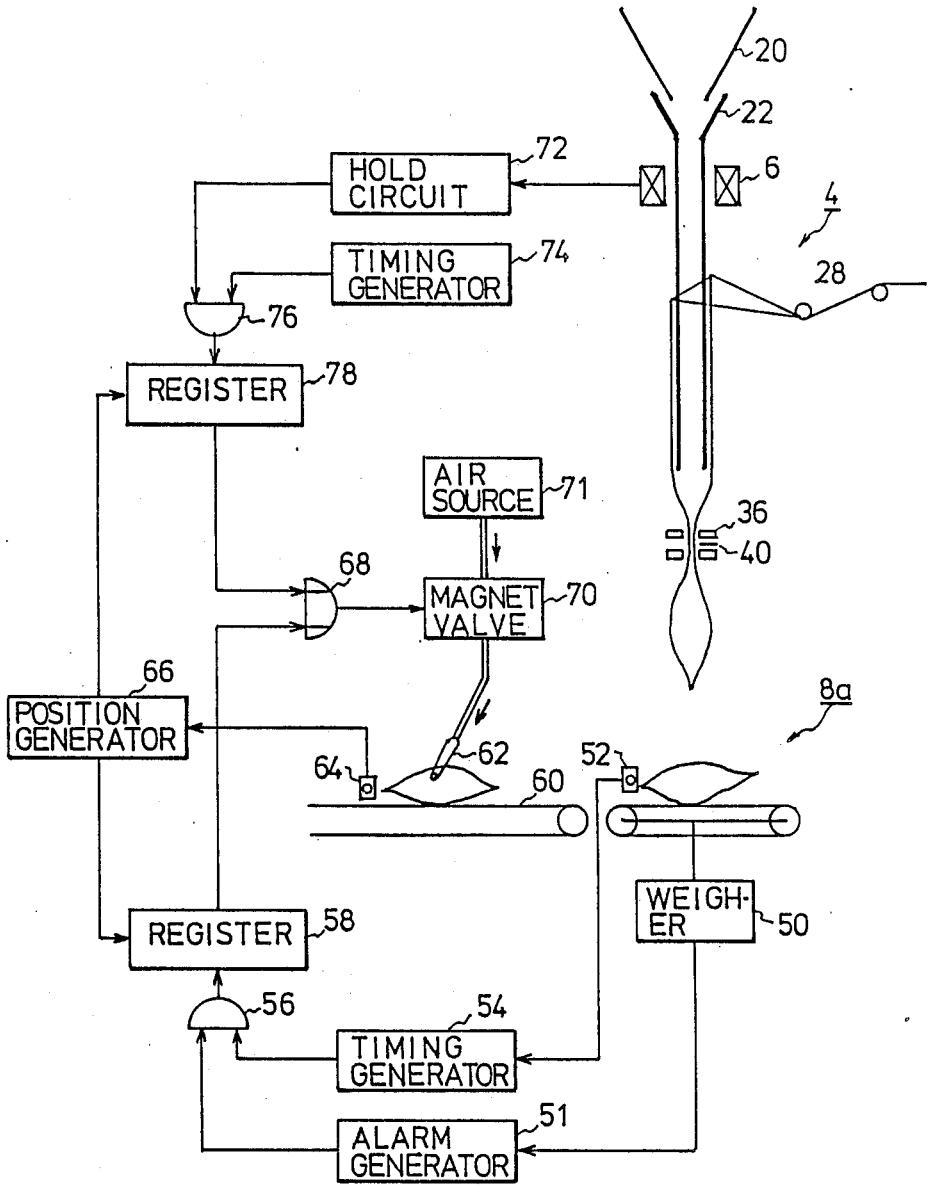
FIG. 4 is a schematic block diagram representing a packing device and deflecting device of a second embodiment of this invention.

In the second embodiment of FIG. 4, a deflecting device **8*a* is adapted to effect a sorting operation based upon the results not only of metal detection but also of weight measurement. More particularly, a weight sorter comprising a weighing conveyer 50 and an alarm signal generator 51 is disposed under the packing device 4. The alarm signal generator 51 judges whether the weight of the package delivered from the packing device 4 is within a predetermined allowable weight range and, if not, supplies an alarm signal to one input of an AND gate 56. Another input of the AND gate 56 is a timing signal supplied from a timing signal generator 54 which provides the timing signal in response to detection of the package on the weighing conveyer 50 by an optical detector 52. The output of the AND gate 56 is stored in a register 58. This stored signal is read out to an OR gate 68 in response to a position signal supplied from a position signal generator 66 in response to detection by another optical detector 64 of the package transferred onto a coveyer 60. The output of OR gate 68 is applied to a magnetic valve unit 70 to pass forced air therethrough from a forced air source 71. The forced air is jetted from a nozzle 62 to blow a defective package having an unacceptable weight off the conveyer 60**.

On the other hand, a metal detection signal from the metal detector 6 is held in a hold circuit 72 and then ANDed in a AND gate 76 with a timing signal provided by a timing signal generator 74 in response to delivery of a defective package onto the weighing conveyer 50. The output of AND gate 76 is stored in another register 78 and also read into the OR gate 68 by the position signal from the position signal generator 66. Accordingly, in the same fashion as in the case of the above-mentioned unacceptable weight, the defective package containing a metallic substance will be blown off the conveyer 60.

Instead of blowing packages unacceptable due either to unallowable weight or metal inclusion in the same direction by a single common nozzle 62, defective packages may be blown in different directions by two nozzles actuated respectively by the outputs of registers 58 and 78. Moreover, instead any of air blowing, sorting method well known in the art, such as flipper and dumping conveyers, can be used for deflecting the defective packages.

Figure 5:
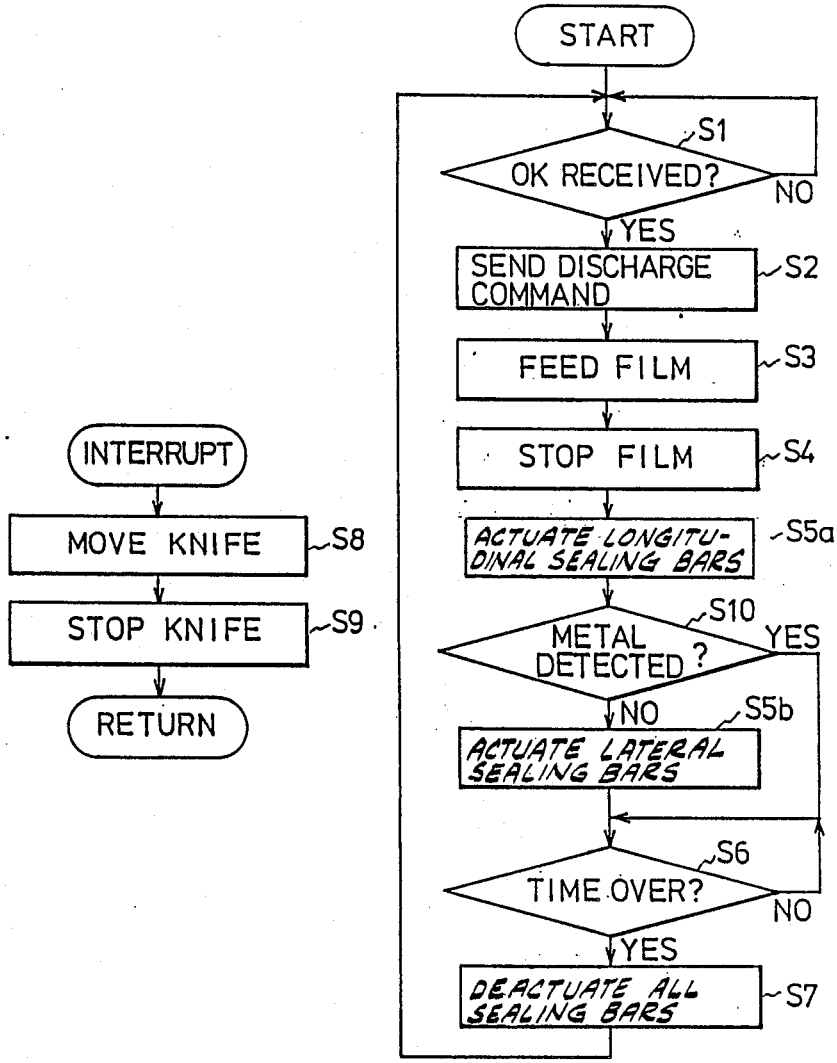
FIG. 5 is a flow chart of a third embodiment of this invention.

While, in the above-mentioned embodiments, defective packages are deflected or blown away, such packages may be distinguished from the normal or acceptable packages by modifying their shape or size. FIG. 5 shows a program used for making the length of defective package twice the normal length. For this purpose, step S5 is divided into two steps S5*a* for actuating the longitudinal sealing bars 32 and S5*b* for actuating the lateral sealing bars 36, with step S10 being inserted therebetween. The step S11 is omitted and the deflector plate 43 is correspondingly omitted or fixed to deliver all packages onto the conveyer 44.

In this program, only the longitudinal sealing bars 32 are actuated in step S5*a* after step S4, and it is then inquired in step S10 whether any metal substance has been detected or not. If not, the lateral sealing bars 36 are actuated in step S5*b* to form the lateral seal and it is inquired in step S6 whether the predetermined time is over or not. If YES, the interrupt routine including steps S8 and S9 is executed to cut off a completed bag for delivery of an acceptable package. However, if the answer of step S10 is YES, that is, if any metal has been detected, step S5*b* is not executed as shown, the interrupt routine is not execute also, and the main routine of FIG. 5 is repeated after step S7. Accordingly, no lateral seal is formed and, if no metal is detected in the next cycle of operation, a package having double length and content is produced. Such abnormal packages are easily distinguishable. If metal is also detected in the second cycle of operation, the length and content of the defective package will be tripled.

It will be easy for those skilled in the art to modify this embodiment for providing the defective package with any suitable length other than integral multiples such as double and triple. Moreover, If step S5*b* is executed even when metal is detected, a double length package having a seal in the middle will be produced unless the interrupt routine is executed.

Figure 6:
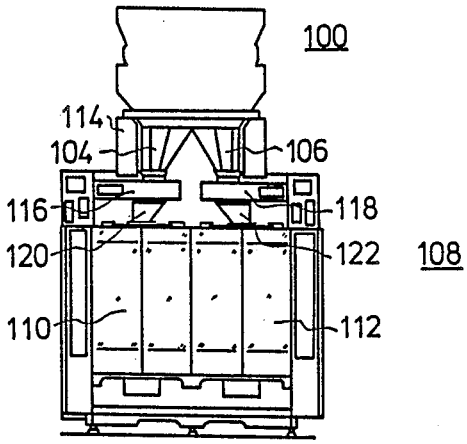
FIG. 6 is a side view representing a schematic structure of a fourth embodiment.

A twin-type combination weighing and packing machine of this invention is shown in FIG. 6. In this machine, a pair of combination weighing devices 100 having a common dispersion feeder and two sets of radial feeding troughs, feed hoppers, weigh hoppers and auxiliary hoppers is supported on a common frame 114. These sets are provided respectively with collection chutes 104 and 106 connecting with chutes 120 and 122 of a pair of packing devices 110 and 112 which form a twin packer 108. The packing devices 110 and 112 may be of the same type as shown in FIGS. 1 and 2. Around the chutes 120 and 122, similar metal detectors 116 and 118 are disposed for detecting metallic substances passing through chutes 120 and 122.

We claim:

1. A weighing and packing device comprising a combination weighing device for combining in various fashion measured weights of quantities of product contained respectively in a plurality of containers, selecting from the resultant combinations a combination having a total weight satisfying a pre-determined condition and discharging the quantities of product forming the selected combination from said containers containing said quantities of product, and a packing device disposed under said combination weighing device for collecting said discharged quantities of product and packing them into a single package, characterized in that said device further comprises a metal detector disposed along the path of said discharged product between said combination weighing device and said packing device for producing a metal detection signal when metal passes said path together with said product, and means for distinguishing from other packages a package containing the product having passed said path when said metal detector produces a metal detection signal.

2. A weighing and packing device, as set forth in claim 1, characterized in that said distinguishing means comprises deflecting means disposed in a succeeding stage of said packing device for deflecting any package containing metal to a path other than the path for other packages not containing metal.

3. A weighing and packing device, as set forth in claim 2, characterized in that said deflecting means functions also as a weight sorter for deflecting any package having a weight out of a predetermined range to a path other than a normal conveying path.

4. A weighing and packing device, as set forth in claim 1, characterized in that said distinguishing means comprises means for controlling said packing device to cause it to modify the geometry of any package including metal from that of other packages not containing metal.

5. Weighing and packing apparatus comprising a combination weighing machine for combining measured weights of quantities of product contained in a plurality of containers, selecting from the resultant combinations of quantities of product an acceptable combination of quantities of product, and discharging the quantities of product corresponding to said acceptable combination, a packing machine disposed below said combination weighing machine for receiving the discharged quantities of product and packing them into a single package, chute means interposed between said combination weighing machine and packing machine and defining a path along which said discharged quantities of product are adapted to move as they fall from the combination weighing machne into said packing machine, a metal detector adapted for detecting metal moving along said path and for generating a signal in response thereto, and means responsive to said signal for identifying a package containing said metal.

6. Weighing and packing apparatus as set forth in claim 5 wherein said identifying means comprises means for deflecting a package containing metal onto a path different from a normal path for packages not containing metal.

7. Weighing and packing apparatus as set forth in claim 6 wherein said deflecting means also functions as a weight sorter for deflecting any packages having a weight out of a predetermined range onto a path different from said normal path.

8. Weighing and packing apparatus as set forth in claim 5 wherein said identifying means comprises means for controlling said packing machine to modify the geometry of a package containing metal from that of a package not containing metal.

* * * * *